United States Patent [19]

Miller

[11] Patent Number: 5,026,114

[45] Date of Patent: Jun. 25, 1991

[54] SWIVEL WHEELCHAIR TRAY

[75] Inventor: Robert L. Miller, Biloxi, Miss.

[73] Assignee: Tasrop, Inc., Miss.

[21] Appl. No.: 496,351

[22] Filed: Mar. 20, 1990

[51] Int. Cl.[5] ..... A47C 7/62

[52] U.S. Cl. ..... 297/194; 297/155; 297/145; 108/49

[58] Field of Search ..... 297/194, 188, 155, 152, 297/145, 153, 161, DIG. 4; 108/49, 42; 280/289 WC

[56] References Cited

U.S. PATENT DOCUMENTS

| | | | |
|---|---|---|---|
| 1,232,757 | 7/1917 | Berkey | 108/49 X |
| 1,324,503 | 12/1919 | Hirsch | 297/161 |
| 1,649,761 | 11/1977 | Vinegard | 297/145 X |
| 2,535,112 | 12/1950 | Woody | 108/49 X |
| 3,415,571 | 12/1968 | Heimont, III | 297/188 |
| 3,870,362 | 3/1975 | Large . | |
| 3,999,798 | 12/1976 | Roulier . | |
| 4,003,598 | 1/1977 | Glaze | 297/194 |
| 4,262,962 | 4/1981 | Yust | 297/194 |
| 4,364,699 | 12/1982 | Koppes . | |
| 4,373,756 | 2/1983 | Purdy et al. . | |
| 4,436,339 | 3/1984 | Alberts | 297/153 |
| 4,455,008 | 6/1984 | Mackon | 297/194 X |
| 4,526,419 | 7/1985 | Bowman et al. . | |
| 4,685,726 | 8/1987 | Wolpert, Jr. | 297/155 X |
| 4,725,160 | 2/1988 | Wood . | |
| 4,779,884 | 10/1988 | Minati . | |
| 4,795,182 | 1/1989 | Dyess et al. . | |

*Primary Examiner*—Jose V. Chen

*Attorney, Agent, or Firm*—Cushman, Darby & Cushman

[57] ABSTRACT

A wheelchair tray assembly is provided which includes a horizontal tray and a vertical rod for pivotally mounting the tray to the leg of the wheelchair. A tubular member is mounted to the wheelchair leg for receiving the rod in a manner which allows the pivotal movement of the tray from in front of an individual in the wheelchair to an out of use position to the side of a wheelchair. The tray is preferably releasably coupled to the rod so that it can be selectively removed from the wheelchair for cleaning or transport of goods thereon. A locking mechanism can be provided so as to prevent inadvertent removal of the tray from the rod.

10 Claims, 3 Drawing Sheets

FIG. 5
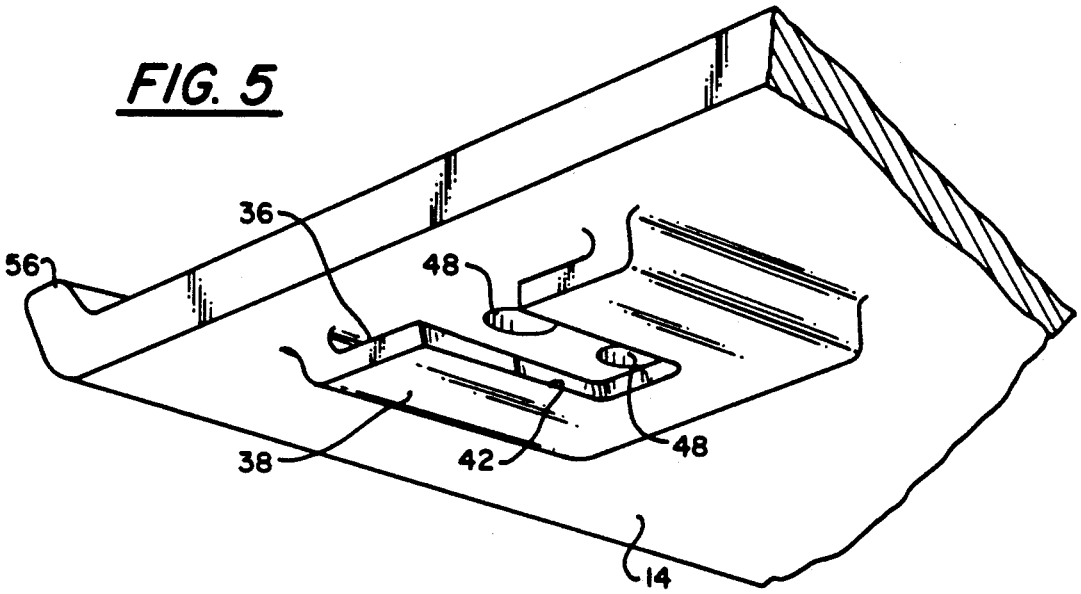
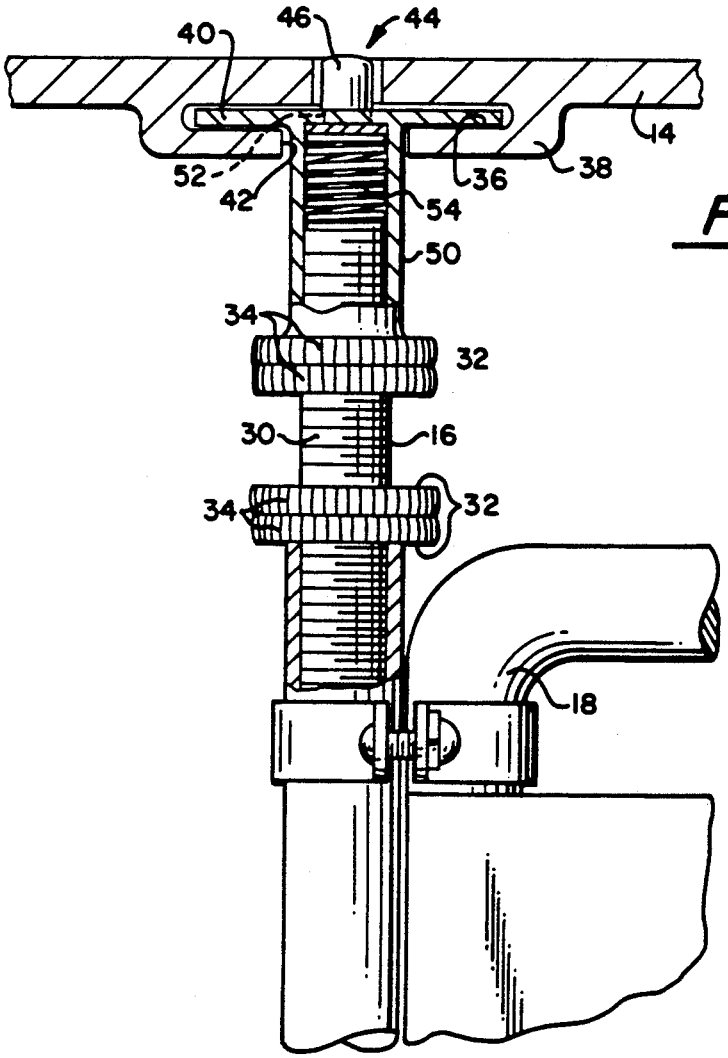
FIG. 6

SWIVEL WHEELCHAIR TRAY

BACKGROUND OF THE INVENTION

1. Field of the Invention

The present invention relates to a tray and, in particular, to a tray which is mountable to a wheelchair and can be pivoted or swiveled with respect thereto.

2. Description of the Related Art

Numerous individuals are permanently confined to wheelchairs or rely upon wheelchairs during a period of convalescence. While wheelchairs greatly enhance the mobility of such handicapped or convalescing persons, wheelchairs have the disadvantage that they can not be brought into close proximity to tables or desks. This makes eating, writing and other activities which require a rigid surface in close proximity to the individual difficult. Some individuals who use wheelchairs place a tray in their lap or across the arms of the wheelchair so that it is possible to eat and write with ease. However, such precariously balanced trays do not provide a stable surface for the user and can easily be dislodged and fall to the floor, spilling their contents. This is not only annoying to the wheelchair user but one confined to a wheelchair can rarely retrieve such a fallen tray, much less the objects originally carried thereby. Thus the wheelchair user is left without food, drink and/or other materials which were carried by the tray.

It has been proposed that a tray or a table-like assembly be mounted to the arm or arms of a wheelchair, for example, in a manner which prevents it from falling or moving out of reach of the user. The disadvantage of such fixedly mounted trays is that once the individual has finished the meal or the tasks for which the tray is needed and the tray is no longer desired, the same cannot be easily removed from in front of the individual.

Other wheelchair and tray combinations are configured so that the tray or table can be moved out from in front of user. However, those trays are typically moved out of the way by turning the same from a horizontal disposition to a vertical disposition and stowing the same by the side of the wheelchair. While such trays can be advantageous, they also have the disadvantage that objects can no longer be carried thereby as soon as the tray is moved to an out-of-the-way position. In addition, the locking and release mechanisms for such tray assemblies generally require a great deal of manual dexterity and/or strength and may be difficult if not impossible for a convalescing or handicapped individual to operate.

It would therefore be desirable to provide a simply constructed and easily operated tray which can be selectively placed in front of an individual in a wheelchair to support plates, glasses, writing materials and the like and moved away from in front of the user so that the user can exit the wheelchair or otherwise be free from obstruction, while still carrying the dishes, glasses and/or writing materials thereon. Thus, with such a tray the user can easily selectively place the tray back into operative position and continue to use the materials disposed thereon.

It would further be desirable to provide such a pivotal or swingable tray which is easy to manipulate by the user so that a great deal of manual dexterity is not required to place the same into operative or inoperative position.

Even further, it would be desirable to provide a tray for a wheelchair wherein the tray can be quickly and easily removed from the wheelchair and selectively reattached thereto so that the tray can be removed when the wheelchair is folded and/or for cleaning. Likewise, it would be desirable to provide such an easily removed wheelchair tray so that one assisting an individual in a wheelchair can carry items to the wheelchair user on the tray and then attach the tray to the wheelchair after which the individual in the wheelchair can selectively place the tray into operative or inoperative position.

SUMMARY OF THE INVENTION

It is an object of the present invention to provide a swivelable wheelchair tray which can be moved into and out of operative position by a simple pivoting movement so that manual dexterity and/or strength are not required to place the same into operative or inoperative position.

It is a further object of the invention to provide a tray for a wheelchair which has an inoperative position wherein the tray is disposed in a horizontal plane so that it can continue to carry objects for the wheelchair user even though it is not disposed immediately in front of the wheelchair user.

It is an even further object of the invention to provide a pivotable wheelchair tray where the tray can be removed from the wheelchair and coupled thereto in a locking manner but which locking attachment can be quickly and easily released with minimal manual dexterity and strength.

Other objects, features, and characteristics of the present invention, as well as the methods of operation and functions of the related elements of the structure, and the combination of parts and economies of manufacture, will become more apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

FIG. 5 is a perspective view from below showing the mounting structure provided on the undersurface of the tray of the invention; and FIG. 6 is an elevational view, partly in section and with parts omitted for clarity showing the mounting structure of the swivel tray of the invention.

DETAILED DESCRIPTION OF THE PRESENTLY PREFERRED EXEMPLARY EMBODIMENTS

Figure 3:
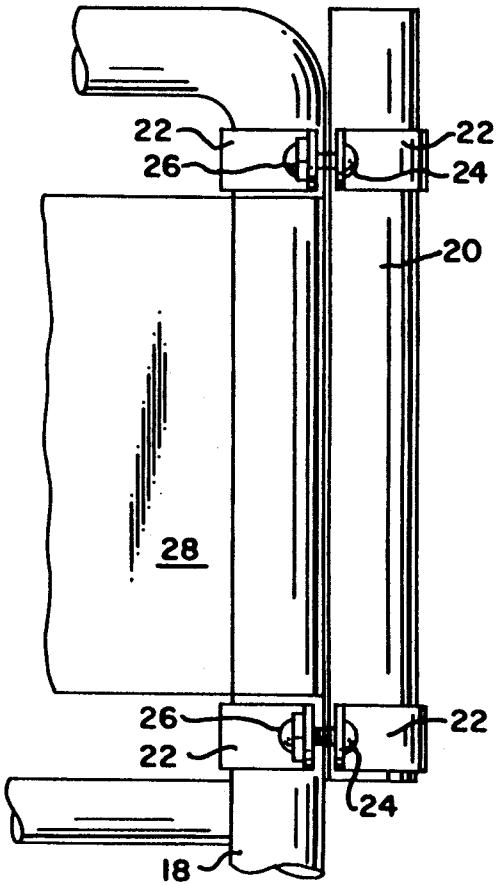
FIG. 3 is an elevational view showing the assembly for mounting the swivel tray of the invention to a wheelchair.
Figure 1:
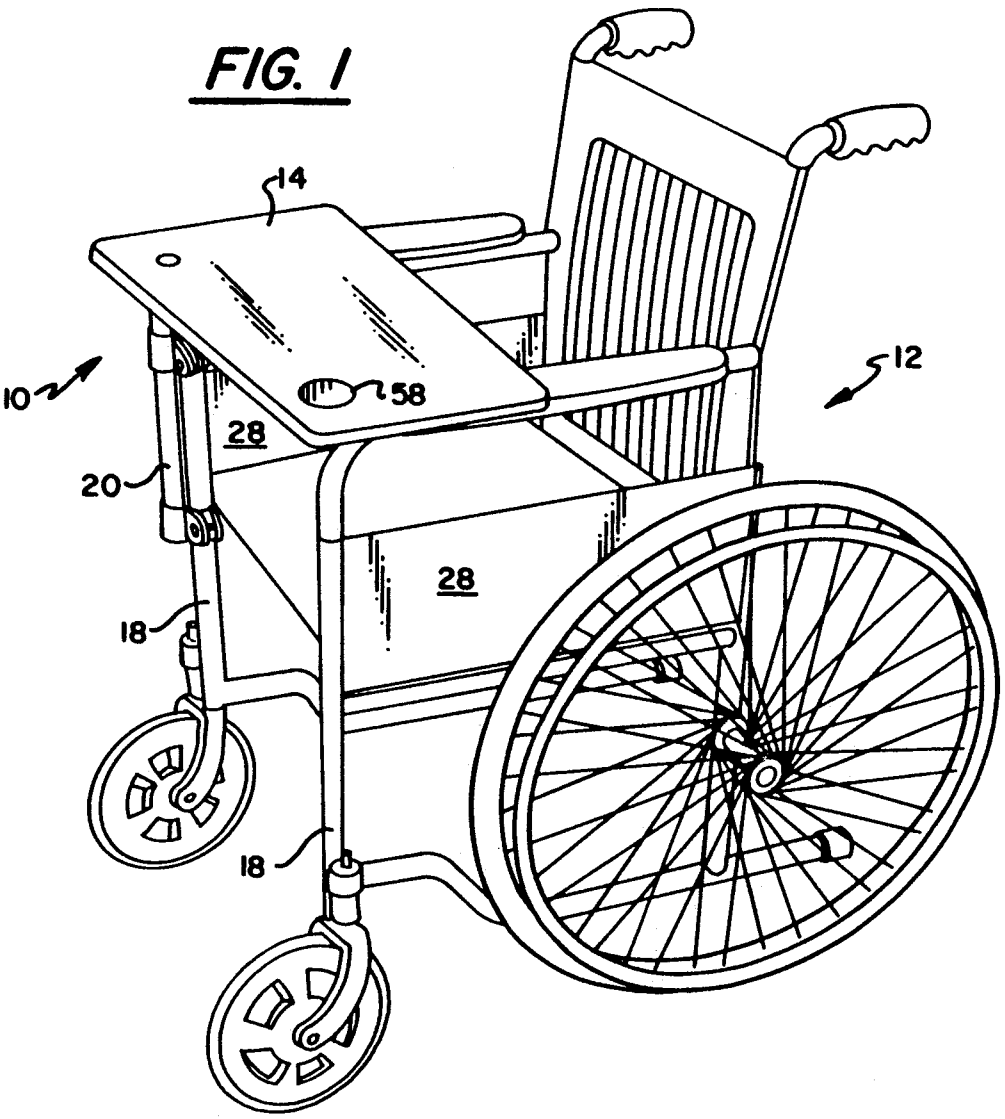
FIG. 1 is a perspective view of a swivel wheelchair tray provided in accordance with the present invention attached to a wheelchair and disposed in its operative position.
Figure 2:
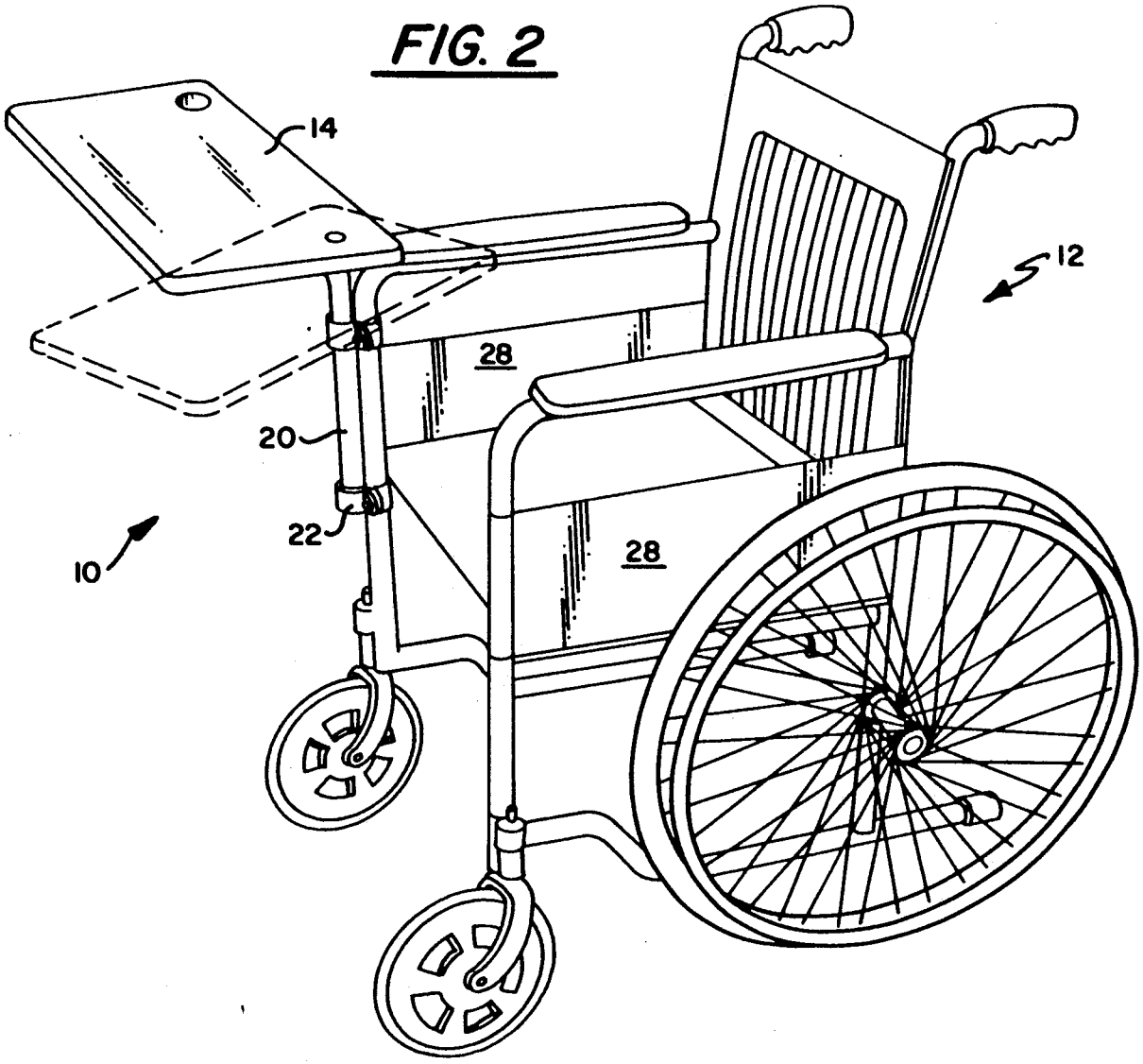
FIG. 2 is a perspective view of a swivel wheelchair tray provided in accordance with the present invention in an out of use position.

Referring to FIGS. 1 and 2, the present invention provides a swivel tray assembly 10 which is mountable to a conventional wheelchair 12. The swivel tray assembly 10 includes a generally horizontal tray element 14, a vertical rod element 16 (FIG. 6) which is coupled to the tray 14 so as to extend vertically downwardly therefrom and which is, in turn, pivotally mounted to the leg 18 of the wheelchair 12. The tray assembly 10 is freely pivotal by virtue of its mounting to the wheelchair leg 18 so that the horizontal tray 14 can be pivoted from the in use disposition shown in FIG. 1 to the storage or inoperative position shown in FIG. 2 and vice versa. As can be seen, the tray 14 retains its horizontal disposition whether it is in the in use position of FIG. 1 or in the out of use position in FIG. 2. Therefore, the tray 14 can continue to hold glasses, plates, writing materials and the like which can be selectively accessed by the wheelchair user.

The tray assembly 10 is mounted to the wheelchair leg 18 so as to be freely pivotal about a vertical axis, as mentioned above. More particularly, in the illustrated embodiment, a tubular member 20 is clamped to the wheelchair leg 18 by, for example, conventional U-clamps 22.

Figure 4:
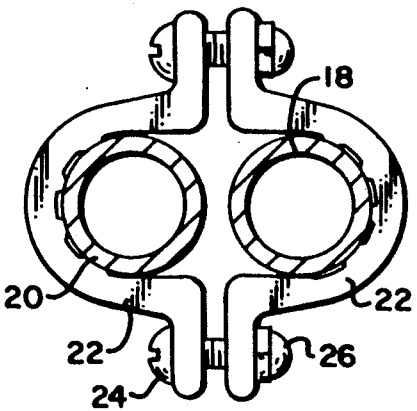
FIG 4 is a top plan view, partly in cross section and with parts omitted for clarity of the mounting structure of FIG. 3.

As shown in FIG. 4, a U-clamp 22 which extends around the tubular member 20 of the wheelchair can be coupled to a U-clamp 22 which extends around the leg 18 by, for example, bolts 24 inserted through aligned apertures. A cap nut 26 or similar element can be provided on the end of each bolt 24 to retain the same in position and to minimize exposed sharp edges. In the illustrated embodiment, the tubular member 20 is clamped both above and below the side support 28 which is typically provided on the sides of the wheelchair 12. As is apparent, by clamping the tubular element 20 in at least two locations, as shown, the vertical stability of the tubular element 20 is insured. The clamps 22 utilized to couple the tubular element to the wheelchair tray can, of course, be formed from any suitable material such as, for example, metal, plastic, or wood. Further, while U-clamps have been illustrated and described, it is to be understood that any known means for mounting the tubular member 20 to the leg 1 could be provided such as a strap or by welding, etc.

The vertical rod 16 of the tray assembly 10 is inserted, in use, into the tubular element 20. In order for the rod 16 to be freely pivotal relative to the tubular element 20, the inner diameter of the tubular element 20 is selected so as to be slightly larger than the outer diameter of the vertical rod 16. While in the illustrated embodiment the tubular member has a smooth inner surface and vertically slidably receives the rod 16 of the tray assembly 10, it is to be understood, as will become more apparent below, that the interior of the tubular member 20 could be threaded so as to threadably receive the vertical rod 16. Such threaded engagement allows the desired pivotal movement although it will be accompanied by a slight height variation between operative and in operative positions.

Whether or not the tubular member 20 has a threaded interior surface, the vertical rod 16 of the tray assembly is preferably provided with screw threads 30 along at least a portion of the length thereof so that one or more nuts 32 can be threadably received on the rod. The nuts 32 limit insertion of the rod 16 into the tubular member 20 as well as control the locking attachment of the tray 14 and rod 16, as described below. Nuts 32 are preferably knurled as shown at 34 to facilitate manual grasping of the same.

Referring to FIG. 6, at least one nut 32 is threaded onto the vertical rod 16 so as to limit insertion of the vertical rod 16 into the tubular member 20. In the illustrated embodiment, first and second nuts 32 are threaded onto the rod so that when the nuts are rotated in opposite directions, they will frictionally engage one another and lock to positively define an insertion limiting position. In the alternative, a single nut 32 can be provided or the rod 16 can be threadably received in the tubular member and the nut omitted in its entirety. Yet a further alternative, when the tubular member threadably receives the vertical rod, is to provide a single nut which can jam with the tubular member.

Referring to FIG. 5, a horizontal slot 36 defining coupling element 38 is preferably mounted to the undersurface of the tray 14 to slidably receive a corresponding plate 40 defined on the vertically upper end of the vertical rod 16. As can be seen, a longitudinal slot 42 is also defined in the coupling element 38 so as to slidably receive the vertical rod 16 itself. Thus, the tray 14 can be horizontally slidably received on the vertically upper end of the vertical rod 16 or slidably detached therefrom so that the tray can be attached to the wheelchair mounted rod 16 or removed therefrom for cleaning, transport, etc. Two or more coupling elements 38 can be provided on the undersurface of tray 14 so that the tray can be mounted to either front leg of the wheelchair or in different lateral positions relative to the user.

In the illustrated embodiment, a lock mechanism 44 is provided on the upper end of rod 16 so that once the rod 16 and tray 14 have been attached, they can be locked in position and then selectively unlocked for tray removal. For example, referring to FIG. 6, a spring loaded button 46 can be provided at the vertically upper end of the vertical rod 16 for selective engagement and disengagement with a corresponding aperture 48 defined through the tray 14. As shown, a plurality of apertures can be provided so that the position of the tray relative to the user can be varied.

The button 46 can be mounted to rod 16 in any suitable manner. In the illustrated embodiment, a hollow cap element 50 is threadably engaged with the vertically upper end of the rod and the button element 46 is inserted through an aperture 52 defined in the uppermost end thereof and urged upwardly relative to the vertical rod 16 with a spring member 54. Thus, the button 46 can be depressed against the force of the spring 54 so as to disengage the button from an aperture 48 in tray 14 and the tray 14 can be slidably removed from rod 16. Similarly, the button 46 can be depressed and the tray 14 slidably engaged with the rod 16. When the button 46 is aligned with an aperture 48 of the tray 14, because it is urged upwardly by the spring 54, it will engage the aperture 48 and lock the tray 14 to the vertical rod 16.

The force required to engage and disengage the button 46 can be varied by varying the relative position of the hollow cap 50 and the rod 16. A lock nut 32 can be provided for limiting the relative movement of these two elements and hence limiting the spring force urging the button 46 upwardly through the aperture 48 of the tray 14.

As is apparent from the foregoing, with the structure of the invention, the tray can be easily pivoted into and out of a use position without requiring a great deal of strength or manual dexterity, as it is not necessary for the user to manipulate any locking or unlocking mechanism to enable such pivoting movement. Likewise, the tray can be easily removed from its mounting structure by depressing a spring mounted button and slidably removing the tray. This operation also requires a minimum amount of strength and/or manual dexterity.

The tray provided in accordance with the invention can have any desired shape and utilitarian features. Thus, for example, the tray can have up turned edges 56 as shown in FIG. 5 to confine material on the tray, and/or a cup holding recess 58 for receiving a glass or a mug.

While the invention has been described in connection with what is presently considered to be the most practical and preferred embodiment, it is to be understood that the invention is not to be limited to the disclosed embodiment, but on the contrary is intended to cover various modifications and equivalent arrangements included within the spirit and scope of the appended claims. Thus, for example, one or more stop elements can be mounted to the vertical rod so as to limit the arc through which the tray can be pivoted by engaging a portion of the leg or the arm of the wheelchair.

What is claimed is:

1. A wheelchair tray assembly comprising:

a tray;

a rod;

means for coupling said tray to said rod, said means for coupling including means for selectively locking said tray to said rod, said means for selectively locking comprising a spring urged button mounted to said rod so as to be substantially coaxial therewith and so as to extend upwardly from a vertically uppermost end of said rod, said spring urged button engaging a corresponding aperture defined through said tray; and means for pivotally mounting said rod to the leg of a wheelchair so that the tray is freely pivotal relative to said wheelchair leg from an in use position in from of an individual in the wheelchair to an out of use position out of the path of the user, said tray being disposed in a horizontal plane in said in use position and in said out of use position.

2. A wheelchair tray assembly as in claim 1, wherein said means for coupling comprise means for releasably coupling said tray to said rod.

3. A wheelchair tray as made as in claim 1, wherein said means for coupling include a disk member on the rod and means defining a horizontal slot on the lower surface of the tray for slidably receiving said disk.

4. A wheelchair tray as in claim 3, wherein said means defining a horizontal slot further defines a vertical slot for slidably engaging said rod beneath said disk.

5. A wheelchair tray as in claim 1, wherein said means for mounting to the wheelchair includes a hollow tubular member and means for rigidly coupling said hollow tubular member to the leg of the wheelchair, the rod being received in said tubular member so as to be pivotal about a vertical axis thereof.

6. A wheelchair tray as in claim 5, wherein the rod is vertically slidably received in the tubular member.

7. A wheelchair tray as in claim 6, further comprising means for limiting insertion of the rod into the tubular member.

8. A wheelchair tray as in claim 7, wherein said rod is threaded along at least a portion of the length thereof.

9. A wheelchair tray as in claim 8, wherein the means for limiting comprise at least one locking nut.

10. A wheelchair tray as in claim 1, including means for varying a spring urging force of said button.

* * * * *